US007108153B2

(12) United States Patent
Wood

(10) Patent No.: US 7,108,153 B2
(45) Date of Patent: Sep. 19, 2006

(54) APPARATUS, SYSTEM, AND METHOD FOR A MEDICATION ACCESS CONTROL DEVICE

(76) Inventor: Brad Wood, 374 N. 100 W., Wellsville, UT (US) 84339

( * ) Notice: Subject to any disclaimer, the term of this patent is extended or adjusted under 35 U.S.C. 154(b) by 225 days.

(21) Appl. No.: 10/763,132

(22) Filed: Jan. 22, 2004

(65) Prior Publication Data

US 2005/0178779 A1 Aug. 18, 2005

(51) Int. Cl.

| | |
|---|---|
| ***B65B 59/00*** | (2006.01) |
| ***G07F 11/66*** | (2006.01) |
| ***G07F 11/72*** | (2006.01) |
| ***B65H 3/00*** | (2006.01) |

(52) U.S. Cl. ..... 221/15; 221/25; 221/30; 221/88; 221/105; 221/152

(58) Field of Classification Search ..... 221/3, 221/7, 5, 2, 88, 25, 26, 15, 30, 69, 87; 368/10; 700/242

See application file for complete search history.

(56) References Cited

U.S. PATENT DOCUMENTS

| | | | | |
|---|---|---|---|---|
| 4,572,403 | A * | 2/1986 | Benaroya | 221/3 |
| 4,798,309 | A | 1/1989 | Stone et al. | 221/4 |
| 5,230,441 | A | 7/1993 | Kaufman et al. | 221/25 |
| 5,392,952 | A | 2/1995 | Bowden | 221/15 |
| 5,405,045 | A * | 4/1995 | Usmani | 221/7 |
| 5,409,132 | A * | 4/1995 | Kooijmans et al. | 221/86 |
| 5,582,323 | A * | 12/1996 | Kurtenbach | 221/2 |
| 5,646,912 | A | 7/1997 | Cousin | 368/10 |
| 5,805,051 | A | 9/1998 | Herrmann et al. | 340/309.4 |
| 6,198,383 | B1 | 3/2001 | Sekura et al. | 340/309.4 |
| 6,234,343 | B1 | 5/2001 | Papp | 221/7 |
| 6,304,797 | B1 | 10/2001 | Shusterman | 700/243 |
| 6,471,087 | B1 | 10/2002 | Shusterman | 221/2 |
| 6,510,962 | B1 | 1/2003 | Lim | 221/15 |

* cited by examiner

*Primary Examiner*—Gene O. Crawford
*Assistant Examiner*—Timothy Waggoner
(74) *Attorney, Agent, or Firm*—Starkweather & Associates; Michael W. Starkweather; Jason P. Webb

(57) ABSTRACT

A medication access control device having a high-strength, high-impact cover and base that allows manual advancing and actuated dispensing of tablets, capsules, or pills of virtually all sizes from a medication cartridge, having penetrable seals, through a dispensing hole located at the base of the device housing. The medication cartridge rests on a cartridge driver rotatably connected to the bottom half of the device housing. A battery powers a timing device and solenoid to draw a locking lug from steps on the cartridge driver. A spring advances a lug lock to hold the locking lug open until the medication cartridge is rotated. As the medication cartridge is rotated a cartridge device tooth advances a trigger, which releases the locking lug and locks the cartridge driver from rotating. A rewind protection lock prevents the cartridge driver from rotating backwards. A switch resets the timer as the cartridge driver is rotated. A tamper proof locking device prevents access to medications housed in the device other than through normal dispensing.

14 Claims, 4 Drawing Sheets

APPARATUS, SYSTEM, AND METHOD FOR A MEDICATION ACCESS CONTROL DEVICE

BACKGROUND OF THE INVENTION

1. Field of the Invention

This invention relates to medication dispensers and, more particularly to a compact, portable, timer-controlled, tamper resistant, manual advancing device capable of providing and controlling access to medication and dosage amounts to a user.

2. Description of the Related Art

The usage of medication in the form of pills to regain and maintain physical and mental health, and the selection, application, and potency of prescription medications, has increased with the advancement of medical science. Likewise, self-taking of prescribed medications by individuals has also increased over the years. This is especially true in instances when medication can be taken in the home to combat diseases or conditions, which, in the past required/allowed user to be hospitalized. With the decrease in the amount of time patients are required to be hospitalized, the self-administration of complex medication without proper supervision has drastically increased. Unfortunately, the adverse effect to a patient who has either improperly taken the correct dosage of medication or who has overdosed on the medication has also increased.

Cases are well documented in every community of medication overdose, misuse, and abuse. These unfortunate actions can lead to various adverse effects on the user's life, as well as those associated with the user, including health risks, personal and social upheaval, reaction, addiction, deceit, fraud and loss of a normal functioning life, such as maintaining a job, caring for family and other basic responsibilities. Non-compliance with self-administered medication schedules is a costly health care problem, which results in increased hospital visits and stays. While a high percentage of those who misuse medications would qualify as high risk, i.e., those with former or current substance abuse or substance addiction issues, those not considered high risk can succumb to the same problems innocently, as they are prescribed use of a highly addictive substance, narcotic, or equivalent prescription, to deal with pain, sleep related problems, depression or other heath issues.

Such risk of addiction concerns prescribing doctors, pharmacists and manufacturers because the risk of misuse and addiction may be more harmful than the condition being addressed. Doctors may under-prescribe to the patient out of such concerns, lessoning the positive effects and attributes that the prescribed medication could provide if taken properly. Free access to a bottle of highly potent, addictive, habit forming medication, can put the physician and the user in an uncomfortable, possibly compromising situation.

The importance of avoiding complications by employing preventive procedures such as the use of intelligent pill dispensers for home use has increased. Present pill devices, however are not well suited for such demanding applications.

In the past these problems were addressed by designing more functions into the device, increasing complexity and cost. Generally, prior home dispensing systems typically are large in size, not readily portable, and do not provide a relative cost effective and easy mechanism to dispense medication. Filling and refilling may require in-home assistance. Transfer and loading of medications by home caregivers rather than a pharmacist introduces the possibility of medication identification errors. By design many of these devices were intended to be provided and supervised by trained caregivers and require monitoring and maintenance. Some of the complexities and functions of these devices include multiple doses in a single compartment, user or caregiver loading of dose compartments, computer programming, computer interfacing, multiple alarm sets, multiple timer set functions, event recording and monitoring, remote monitoring, and audio and visual alarms. These capabilities are labor intensive, timely, and costly.

In contrast, simplified devices provide help in maintaining dose schedules but generally lack adequate overdose protection features.

What is needed is a method, process, and system that allows user access to the medication only at prescribed intervals anywhere the user is situated, yet simple and small enough to maintain inexpensive manufacturing costs. Beneficially, such an apparatus, and system would provide drug manufacturers, prescribing physicians and pharmacies with a level of confidence that the intended use of the medication will be complied with and would provide the user with a compact dispenser that ensures a certain level of protection from possible misuse, dependence or addiction.

Accordingly, a goal of the present invention is to provide an improved pill dispenser without the deficiencies and disadvantages of the above mentioned devices. Specifically, the goal is to provide a simple, reliable, secure, portable, and programmable pill dispenser that has a compact high-strength, tamper resistant outer housing and a plurality locks, holds, and triggers for preventing the pill taker from removing from the pill dispenser more than the prescribed amount of medication during any particular preprogrammed time frame.

Additional features and advantages will become apparent in studying the ensuing drawings and description.

SUMMARY OF THE INVENTION

The present invention has been developed in response to the present state of the art, and in particular, in response to the problems and needs in the art that have not yet been fully solved by currently available pill dispensing devices. Accordingly, the present invention has been developed to provide an apparatus and system for dispensing medication that overcome many or all of the above-discussed shortcomings in the art.

A feature of the present invention is to provide a medication access control device having a high-strength, high-impact cover and base that allows manual advancing and dispensing of tablets, capsules, or pills of virtually all sizes from a medication cartridge with penetrable seals or a refillable cartridge, through a dispensing hole located at the base of the device housing. The medication cartridge rests on a cartridge driver rotatably connected to the base of the device housing. A battery powers a timing device and solenoid to draw a locking lug from the cartridge driver. A spring locks the locking lug in a hold position until the medication cartridge is rotated. As the medication cartridge is rotated a trigger releases the locking lug, which locks the cartridge driver from rotating. A rewind protection member prevents the cartridge driver from rotating backwards. A switch resets the timer as the cartridge driver is rotated.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
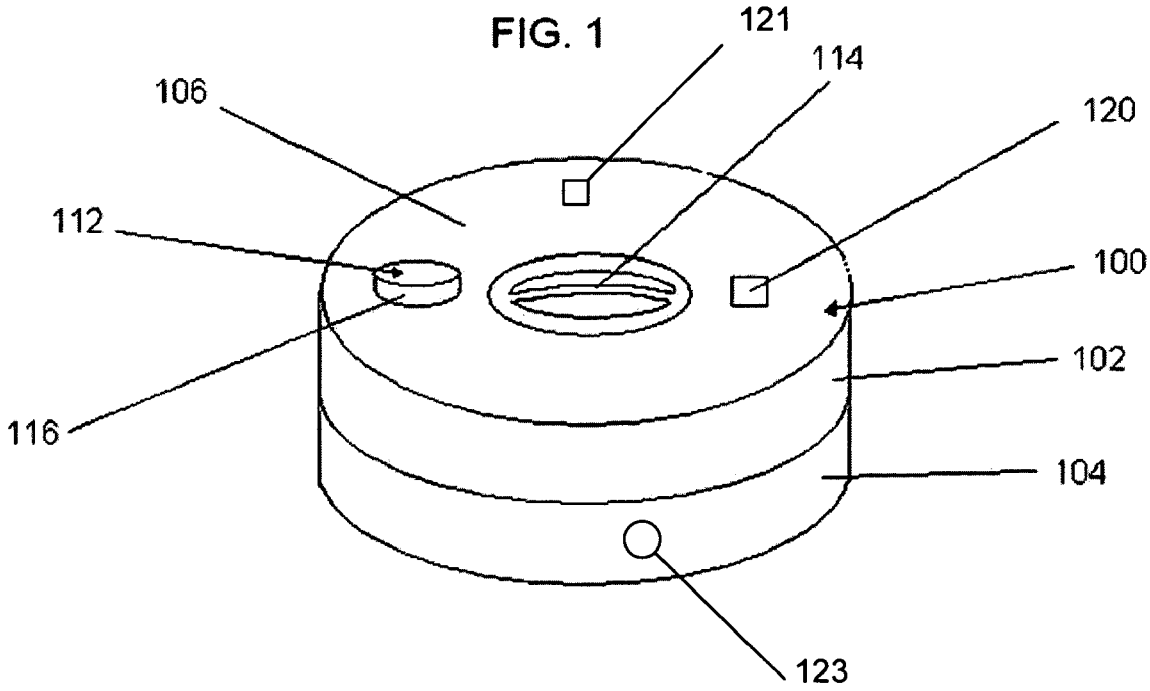
FIG. 1 is a front perspective view of the medication access control device.

FIG. 1 shows a medication access control device 100 according to one aspect of the present invention. According to the figure, there is a portable compact medication dispensing and regulating device 100 that includes a housing 102 having a base 104 and a cover 106. In one embodiment, the base 104 and the cover 106 are factory sealed. In another embodiment the base 104 and the cover 106 are hingedly coupled and can be opened and reloaded by a pharmacist, physician or caregiver. However, it will be recognized that any suitable coupling of the base 104 to the cover 106 may be used. A lock 128, or any other capable locking device, passing through the cover 106 into the base 104 locks the base 104 and cover 106 together. It should be noted that other locking configurations are possible, including positioning a lock through the base 104. Preferably, the lock 128 is covered. In another embodiment, the housing 102 optionally may include a hole substantially located in the center of the cover 106. The housing 102 is ideally small enough to be carried, placed in a pocket, or in a purse. A spring-loaded actuator 112 has a threaded head 116 that secures into the cover 106 to lock and unlock the mechanics of the device 100. It is contemplated, in one embodiment, to include a window 120 that permits the user to view the quantity of the medication remaining in the medication cartridge 108.

Figure 2:
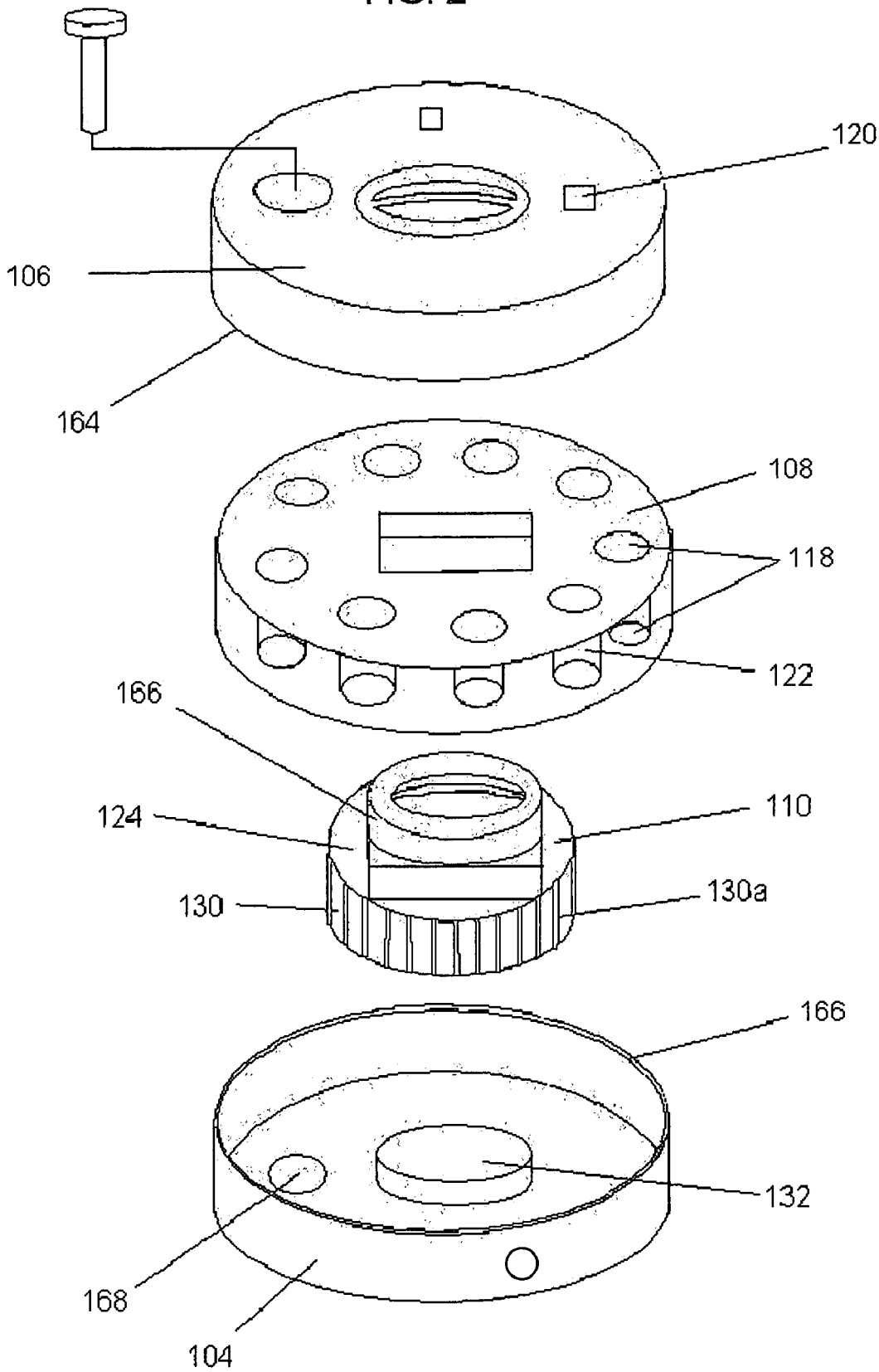
FIG. 2 is an exploded view of the medication access control device including the medication cartridge and cartridge driver.

FIG. 2 illustrates one embodiment of a medication access control device 100. In this embodiment, the cover 106 and base 104 include an outer 164 and inner lip 166 respectively to seal the housing 102. The base 104 includes a pill expel hole 168 substantially aligned with the actuator 112.

It is also contemplated in one embodiment, to include a handle 114, a medication cartridge hold 124, and a stop 126 to make up a rotational cartridge driver 110 adapted for rotational advancement of medication. The cartridge driver 110 extends the full height of the housing 102. The handle 114 passes through the cover 106 to allow manual rotation of the cartridge driver 110. Preferably, in this embodiment, the handle 114 should be large enough to permit easy rotation yet small enough to keep forces acting on the stop 126 low enough to not cause breakage.

In the illustrated embodiment, the medication cartridge 108 is ring-shaped and includes a substantially centrally located hole 164 extending there through. Although, in other embodiments, the cartridge 108 may be most any shape and not include a hole. The hole 164 is sized to fit over the cartridge driver hub 166 and rest atop the cartridge hold 124. In this embodiment the inner hole 132 of the medication cartridge 108 is square, however, it will be recognized that other shapes and designs can be used to accomplish the same effect, including the use of keys and pins. In another embodiment the cartridge is permanent and not removable, but may be reloaded by a doctor, a pharmacist, or a caregiver.

The medication cartridge 108 includes a plurality of dispensing holes 122 for housing the medication. The dispensing holes 122 are arranged in around the periphery and substantially equally spaced apart, and include any number of dispensing holes 122, but most likely corresponding from fourteen to sixty day prescriptions. The dispensing holes 122 are substantially aligned with the actuator 112 and a pill expel hole 168. The dispensing holes 122 are sealed on the top and bottom with a penetrable seal 118. Each dispensing hole 122 is shaped and sized so as to enable commonly sized and shaped tablets or other solid form of pharmaceutical preparations to fit therein. It should be noted however, that the dispensing holes 122 could be made to fit any size tablet subject to the dimensions of the device housing 102.

The medication cartridge 108 is releasably connected to the medication cartridge hub 166, which allows removal from the device housing 102 so that refills or other medication cartridges 108 and cartridge drivers 110 can suitably be installed. The medication cartridge 108 may be suitably made from a variety of materials including plastic and other conventional material used to package tablets.

The stop 126 includes a plurality of steps 130 extending radially from the stop 126. The number of steps 130 may be equal to the number of dispensing holes 122 in the medication cartridge 108 and are positioned to substantially align the dispensing holes 122 with the actuator 112 and the pill expel hole 168.

In operation, as the handle 114 is turned, the cartridge driver 110 rotates the medication cartridge 108 to the next available dispensing hole 122. When the actuator 112 is aligned with the dispensing hole 122, the user presses the actuator 112 through both the top and bottom penetrable seals 118 at the dispensing hole 122 to expel the medication. The reload model would drop medication through the hole upon rotation.

The housing 102 and handle 114 may be made from any kind of material suitable for high-strength and capable of withstanding high-impact forces. Materials such as plastic, composite, and metal may be used.

In one embodiment, the base 104 includes a post 132 substantially located in the center for accepting the cartridge driver 110. The cartridge driver 110 includes a hole substantially located in the center for accepting the post 132. The cartridge driver 110 rotates around the post 132 when the handle 114 is rotated.

Figure 3:
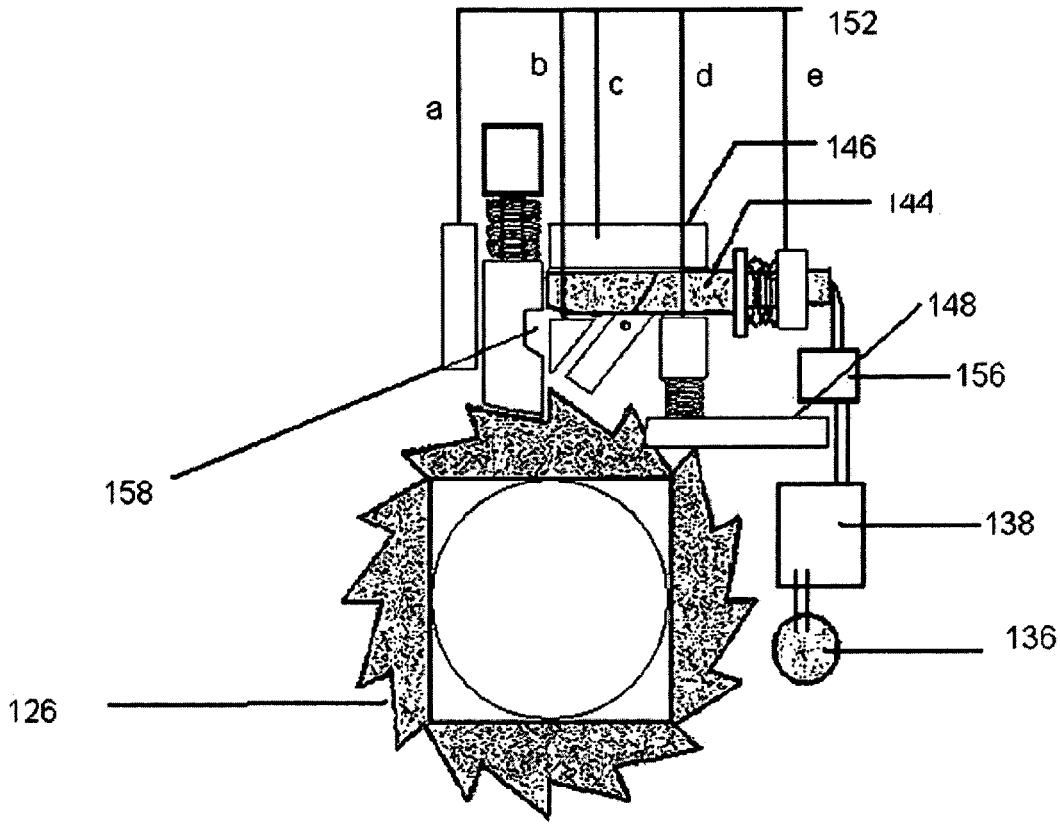
FIG. 3 is a top view of the internal control and prevention system in the closed position.

FIG. 3 illustrates another embodiment where the medication access control device 100 has an internal control and prevention system 134. The control and prevention system 134 includes a battery 136 and a timer 138. The timer 138 is preprogrammed according to the pharmacist's, physician's, or manufacturer's timing requirements needed between each dosage. In one embodiment, the battery 136 can be replaced and the timer 138 can be reprogrammed when the device 100 is refilled.

In another embodiment, body guides 152*a*, 152*b*, 152*c* hold a locking lug 142 in position and permit the locking lug 142 to slide in and out radially from the cartridge driver 110. Body guides 152*b*, 152*c*, 152*d* hold a lug lock 144 in position and permit the lug lock 144 to slide perpendicular to the locking lug hold 158. A trigger 146 is rotatably coupled to the lug lock 144 with a pin 162. However, it will be recognized that any suitable coupling of the trigger 146 to the lug lock 144 may be used, including using a compliant mechanism. A rewind protection member 148 is rotatably connected to the base 104 with a pin 160 and rewind protection spring 150. In the lock position the locking lug 142 prevents the user from turning the handle 114 to rotate the cartridge driver 110 to the next dispensing hole 122. Similarly, a rewind protection member 148 prevents the cartridge driver 110 from rotating backwards. In the lock position, the cartridge driver 110 does not rotate and the user cannot remove any medication except for that medication immediately located in the dispensing hole 122 of the medication cartridge 108.

Figure 4:
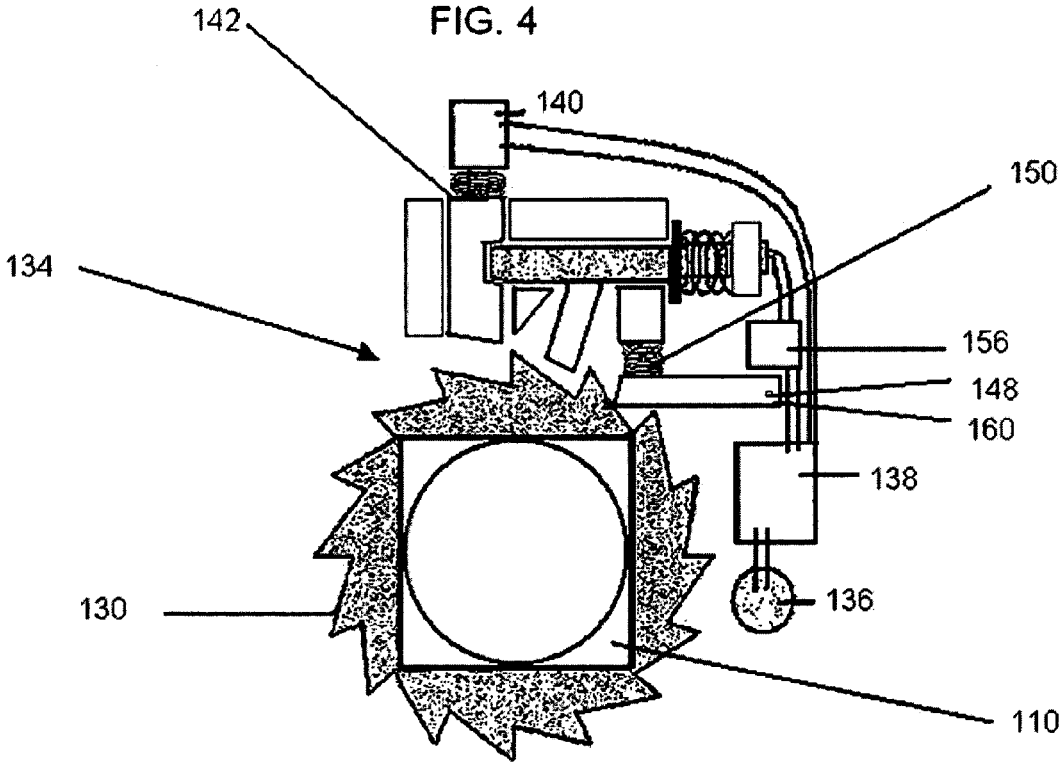
FIG. 4 is a top view of the internal control and prevention system in the open position.

FIG. 4 is an example of one embodiment of an internal control and prevention system 134 in the open position. When the preprogrammed time has expired according to the timer 138, the user is notified by an indicator at window 121 that the device internal control and prevention system 134 has unlocked and that medication is available. A solenoid 140 draws the locking lug 142 from the steps 130 of the cartridge driver 110. When the locking lug 142 has been fully drawn, a lock spring 154 pushes the lug lock 144 into a locking lug hold 158. When the user turns the handle 114 to rotate the cartridge driver 110, a step 130*a* rotates the trigger 146 around body guide 152*b*, and forces the lug lock 144 to slide back and release the locking lug 142 from the locking lug hold 158. At the same time, the locking lug 142 drops back into the lock position as shown in FIG. 3. The new position allows the user to push the actuator 112 through the penetrable seals 118 on the medication cartridge 108 and expel the medication out of the device 100. When the open lock 144 releases the locking lug 142 and recedes, a switch 156 is triggered to restart the timer 138. The advantage if this design is that only one dispensing process can take place, even when several medication dispensing timings have expired. This prevents someone from letting several medication dispensing times lapse and then taking double, triple or more dosage at once. I other words, even if two or more dispensing times have lapsed, the present invention will allow only one dispensing of the drug to take place.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A medication access control device, comprising:

a housing having a base and a cover;

a medication cartridge, having a rotational member and plurality of dispensing holes;

a manual actuator including a threaded head for locking the actuator in an expel position;

a locking lug configured to prevent the rotational member from rotating; and a rewind protection member configured to prevent the rotational member from rotating in reverse.

2. The medication access control device of claim 1, wherein the dispensing holes are housed in a penetrable seal that is located on both a top and bottom side of the dispensing holes.

3. The medication access control device of claim 1, wherein the actuator acts as a lock when medication has been expelled.

4. The medication access control device of claim 1, wherein the cover includes a window for viewing the medication cartridge and a window for displaying the device status.

5. The medication access control device of claim 1, wherein the housing is made of a rigid material.

6. The medication access control device of claim 1, further comprising a handle that passes through the cover of the housing.

7. The medication access control device of claim 1, wherein the base and a cover are sealed together to prevent opening thereof.

8. The medication access control device of claim 1, wherein said housing is coupled together with a hinge and locked with a locking device.

9. The medication access control device of claim 1, wherein said medication cartridge can be removed and replaced.

10. The medication access control device of claim 1, wherein said rotational member can be removed and replaced by one other than the user to correspond to the dosage requirements of die medication cartridge.

11. A medication dispensing device, comprising:

a battery;

a countdown timer, electrically coupled to the battery;

a solenoid, electrically coupled to the timer and the battery;

a locking lug connected to said solenoid;

a lug lock for holding the locking lug in a retracted position;

a spring that advances the lug lock into a locking lug hold;

a trigger for releasing the lug lock from the locking lug; and a rewind protection member configured to prevent a rotational member from rotating in reverse.

12. The medication access control device of claim 11, wherein said solenoid retracts said locking lug from said rotational member.

13. The medication access control device of claim 11, wherein a tooth from the rotational member actuates the trigger to release the lug lock from the locking lug.

14. The medication access control device of claim 11, wherein the medication access control device can have the timer reprogrammed.

* * * * *